US009366244B2

(12) United States Patent
Caughley

(10) Patent No.: US 9,366,244 B2
(45) Date of Patent: Jun. 14, 2016

(54) DRIVE SYSTEM FOR A PRESSURE WAVE GENERATOR

(75) Inventor: Alan James Caughley, Christchurch (NZ)

(73) Assignee: Callaghan Innovation, Lower Hutt (NZ)

( * ) Notice: Subject to any disclaimer, the term of this patent is extended or adjusted under 35 U.S.C. 154(b) by 1063 days.

(21) Appl. No.: 12/936,884

(22) PCT Filed: Apr. 7, 2009

(86) PCT No.: PCT/NZ2009/000051
§ 371 (c)(1),
(2), (4) Date: Dec. 22, 2010

(87) PCT Pub. No.: WO2009/126050
PCT Pub. Date: Oct. 15, 2009

(65) Prior Publication Data

US 2012/0076677 A1 Mar. 29, 2012

(30) Foreign Application Priority Data

Apr. 7, 2008 (NZ) ..... 567264

(51) Int. Cl.
*F04B 43/067* (2006.01)
*F04B 43/02* (2006.01)
*F04B 45/053* (2006.01)
*F25B 9/00* (2006.01)

(52) U.S. Cl.
CPC ..... *F04B 43/02* (2013.01); *F04B 43/067* (2013.01); *F04B 45/0533* (2013.01); *F25B 9/00* (2013.01)

(58) Field of Classification Search
CPC ..... F04B 43/1067; F04B 45/10533; F04B 43/067; F04B 45/0533
USPC ..... 60/571–573; 417/385
See application file for complete search history.

(56) References Cited

U.S. PATENT DOCUMENTS

| | | | | |
|---|---|---|---|---|
| 1,851,666 | A * | 3/1932 | Evans | 417/383 |
| 2,546,462 | A * | 3/1951 | Link | 60/573 |
| 4,019,335 | A | 4/1977 | Browning | |
| 4,305,252 | A * | 12/1981 | Carle et al. | 60/571 |
| 4,324,100 | A | 4/1982 | House | |
| 4,913,809 | A | 4/1990 | Sawada et al. | |
| 5,228,291 | A * | 7/1993 | Meyering | 60/571 |

FOREIGN PATENT DOCUMENTS

WO WO 2006/112741 A 10/2006

* cited by examiner

*Primary Examiner* — F. Daniel Lopez
(74) *Attorney, Agent, or Firm* — Frommer Lawrence & Haug LLP

(57) ABSTRACT

A drive system for driving a diaphragm pressure wave generator comprising opposed first and second diaphragms (11, 13) that are each coupled at or toward opposite ends of a reciprocally moveable drive piston (19). The drive system comprises an operable actuator (27) that generates a reciprocating motion output having a low force and long stroke. The drive system also comprises a hydraulic amplifier that is operatively coupled between the actuator and the drive piston, the hydraulic amplifier being arranged to convert the reciprocating motion output from the actuator into an amplified output having a higher force and shorter stroke, and apply the amplified output to the drive piston (19) to cause the drive piston and opposed diaphragms (11,13) to reciprocate and generate waves.

49 Claims, 3 Drawing Sheets

DRIVE SYSTEM FOR A PRESSURE WAVE GENERATOR

This application is a 371 of PCT/NZ2009/000051 filed on Apr. 7, 2009, published on Oct. 15, 2009 under publication number WO 2009/126050 A and claims priority benefits of New Zealand Patent Application No. 567264 filed Apr. 7, 2008, the disclosure of which is incorporated herein by reference.

FIELD OF THE INVENTION

The present invention relates to a drive system for a pressure wave generator. In particular, although not exclusively, the drive system is for driving a diaphragm pressure wave generator that is being used in a cryogenic refrigerator system.

BACKGROUND TO THE INVENTION

Many cryogenic refrigerators, such as Stirling refrigerators and pulse tubes, are driven by a reciprocating pressure wave. Conventionally, the pressure waves are generated by clearance gap pistons that are driven by linear motors, although these are costly technologies. More recently, diaphragm based pressure wave generators have been proposed. These diaphragm pressure wave generators use low cost diaphragms manipulated in a reciprocating manner to generate pressure waves in an efficient and cost effective manner. A significant benefit of diaphragm pressure wave generators for cryogenic refrigerator systems is that the diaphragms separate the clean gas environment required by the cryogenic cooler from the drive system that reciprocates the diaphragms. This allows cheaper driving components, such as standard rotary and crank mechanisms, to be used in the pressure wave generator.

By way of example, international PCT patent application publication WO 2006/112741 proposes a diaphragm pressure wave generator that comprises, in one form, a pair of opposed diaphragms that are moved in a reciprocating motion by a reciprocating drive piston to create pressure waves.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved drive system for diaphragm pressure wave generators, or to at least provide the public with a useful choice.

SUMMARY OF THE INVENTION

In a first aspect, the present invention broadly consists in a drive system for driving a diaphragm pressure wave generator, the pressure wave generator comprising opposed first and second diaphragms that are each coupled at or toward opposite ends of a reciprocally moveable drive piston, the drive system comprising: an operable actuator that generates a reciprocating motion output; a master piston that is driven by the output of the actuator in a reciprocating motion within a double-acting balanced master cylinder having two ends; and opposed slave pistons being reciprocally moveable within respective slave cylinders, each slave piston being arranged to act on a respective end of the drive piston and each slave cylinder being operatively connected to a respective end of the master cylinder for hydraulic fluid communication such that the master piston drives the slave pistons via hydraulic fluid moving between the master and slave cylinders, the slave pistons having a larger cross-sectional area than the master piston such that reciprocating motion of the master piston at a low force and long stroke causes reciprocating motion of the slave pistons at a higher force and shorter stroke to thereby reciprocate the drive piston and opposed diaphragms to generate pressure waves.

In one form, the master cylinder and slave cylinders may be indirectly operatively connected by hydraulic lines that carry hydraulic fluid between the cylinders in response to movement of the master piston. Preferably, the master cylinder comprises first and second chambers on either side of the master piston, each chamber being formed at or toward an end of the master cylinder, and wherein the hydraulic lines carry hydraulic fluid between the first and second chambers of the master cylinder and a respective slave cylinder.

Preferably, the drive system further comprises a piston rod that extends from one side of the master piston through the first chamber of the master cylinder and a balancing rod that extends from the opposite side of the master piston through the second chamber of the master cylinder. More preferably, the piston rod may be coupled to the output of the actuator in order to reciprocate the master piston within its master cylinder.

Preferably, the actuator comprises a rotatable crank shaft having a crank to which a conrod is coupled such that rotation of the crank shaft by a motor causes reciprocating motion of conrod, the conrod being operatively coupled to the piston rod of the master piston to drive it back and fourth in a reciprocating motion within its master cylinder.

In another form, the master cylinder and slave cylinders may be directly coupled to each other such that they share the same cylinder cavities. Preferably, each end of the master cylinder extends directly into a respective slave cylinder. More preferably, the master and slave cylinders are integrally formed as one component, but alternatively the master and slave cylinders are separate components that are fixed together.

Preferably, the actuator may comprise a pair of counter-rotating crank shafts located on opposite sides of the master piston, the crank shafts connected to each other by a pair of gears in such a manner as to achieve synchronous counter rotation, each crank shaft having a crank to which a conrod is coupled, the conrods being operatively coupled to respective ends of a link bar that is coupled to the master piston, wherein rotation of the crank shafts by a motor causes reciprocation of the link bar to thereby reciprocate the master piston within its master cylinder.

Preferably, the drive piston reciprocates back and forth along a drive piston axis that extends through its longitudinal center. More preferably, the slave pistons are arranged to reciprocate back and fourth along a slave piston axis that is substantially coaxial with the drive piston axis of the drive piston. In one form, the master piston is arranged to reciprocate back and fourth along a master piston axis that extends substantially perpendicular to the slave piston axis. In another form, the master piston is arranged to reciprocate back and fourth along a master piston axis that is substantially parallel or aligned with the slave piston axis.

Preferably, the drive piston may comprise a body having opposed circular top and bottom end plates, the first and second diaphragms being annular with inner and outer edges, the inner edges of the first and second diaphragms being fixed to the respective outer peripheral edges of the top and bottom end plates of the drive piston, and the outer edges of the diaphragms being fixed within a housing of the pressure wave generator.

Preferably, the top and bottom end plates of the drive piston may comprise external surfaces that face respective gas spaces within which the diaphragms move to create pressure waves and internal surfaces that face inwardly toward the body of the drive piston and the sealed environment between the opposed diaphragms.

In one form, the entire drive system may be located substantially between the opposed diaphragms in the housing of the pressure wave generator. In another form, the operable actuator, master piston and master cylinder are located outside the housing of the pressure wave generator.

In one form, each of the slave pistons may be arranged to abut the internal surface of a respective end plate of the drive piston such that extension of the slave piston from its slave cylinder causes a corresponding displacement of the drive piston in the same direction. In another form, each of the slave pistons may be fixed to the internal surface of a respective end plate of the drive piston such that extension of the slave piston from its slave cylinder causes a corresponding displacement of the drive piston in the same direction.

Preferably, each slave cylinder comprises a relief duct or duct(s) that are arranged to vent hydraulic fluid to a tank or tanks if the slave pistons extend beyond a predetermined distance from their respective slave cylinders during operation.

Preferably, the drive system may further comprise a hydraulic pump that is arranged to pump hydraulic fluid from a reservoir tank into the master and/or slave cylinders to top up the hydraulic fluid supply when required. More preferably, the hydraulic pump may be arranged to pump hydraulic fluid into the master and/or slave cylinders via hydraulic oil supply lines having one or more check valves.

Preferably, the master:slave piston cross-sectional area ratio may be in the range of about 1:5 to about 1:15. More preferably, the master:slave piston cross-sectional area ratio is in the range of about 1:10.

In operation, as the master piston reciprocates back and forth within its master cylinder, the slave pistons move in a reciprocating motion by extending from and then retracting back into their respective slave cylinders in an alternate fashion to thereby cause reciprocating motion of the drive piston and opposed diaphragms to generate pressure waves. For example, when one slave piston is extending, the opposite slave piston is retracting.

In one form, the diaphragm pressure wave generator may be utilised to drive cryogenic refrigerator systems, such as Stirling refrigerators and pulse tubes, or heat pumps. In alternative forms, the pressure wave generator may be utilised as a helium pump for cryogenic refrigerator systems, or as a pump for other fluids and gases.

In a second aspect, the present invention broadly consists in a drive system for driving a diaphragm pressure wave generator, the pressure wave generator comprising opposed first and second diaphragms that are each coupled at or toward opposite ends of a reciprocally moveable drive piston, the drive system comprising: an operable actuator that generates a reciprocating motion output having a low force and long stroke; and a hydraulic amplifier that is operatively coupled between the actuator and the drive piston, the hydraulic amplifier being arranged to covert the reciprocating motion output from the actuator into an amplified output having a higher force and a shorter stroke, and apply the amplified output to the drive piston to cause the drive piston and opposed diaphragms to reciprocate and generate pressure waves.

Preferably, the hydraulic amplifier may comprise: a master piston that is driven by the output of the actuator in a reciprocating motion within a double-acting balanced master cylinder having two ends; and opposed slave pistons being reciprocally moveable within respective slave cylinders, each slave piston being arranged to act on a respective end of the drive piston and each slave cylinder being operatively connected to a respective end of the master cylinder for hydraulic fluid communication such that the master piston drives the slave pistons via hydraulic fluid moving between the master and slave cylinders, the slave pistons having a larger cross-sectional area than the master piston such that reciprocating motion of the master piston at a low force and long stroke causes reciprocating motion of the slave pistons at a higher force and shorter stroke to thereby reciprocate the drive piston and opposed diaphragms to generate pressure waves.

In a third aspect, the present invention broadly consists in a drive system for driving opposed first and second diaphragms that are each coupled at or toward opposite ends of a reciprocally moveable drive piston, the drive system comprising: an operable actuator that generates a reciprocating motion output; a master piston that is driven by the output of the actuator in a reciprocating motion within a master cylinder having two ends; and opposed slave pistons being reciprocally moveable within respective slave cylinders, each slave piston being arranged to act on a respective end of the drive piston and each slave cylinder being operatively connected to a respective end of the master cylinder for hydraulic fluid communication such that the master piston drives the slave pistons via hydraulic fluid moving between the master and slave cylinders, the slave pistons having a larger cross-sectional area than the master piston such that reciprocating motion of the master piston at a low force and long stroke causes reciprocating motion of the slave pistons at a higher force and shorter stroke to thereby reciprocate the drive piston and opposed diaphragms.

The second and third aspects of the present invention may comprise any one or more of the features mentioned in respect of the first aspect of the invention.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

The invention consists in the foregoing and also envisages constructions of which the following gives examples only.

BRIEF DESCRIPTION OF THE DRAWINGS

Preferred embodiments of the invention will be described by way of example only and with reference to the accompanying drawings, in which.

DETAILED DESCRIPTION OF PREFERRED EMBODIMENTS

The invention relates to a drive system for driving a diaphragm based pressure wave generator. In particular, although not exclusively, the drive system is suited to driving a pressure wave generator comprising opposed first and second diaphragms. By way of example, the drive system will be described in the context of a diaphragm pressure wave generator like that proposed in WO 2006/112741, which is incorporated herein by reference.

First Preferred Form of Drive System

Figure 1A:
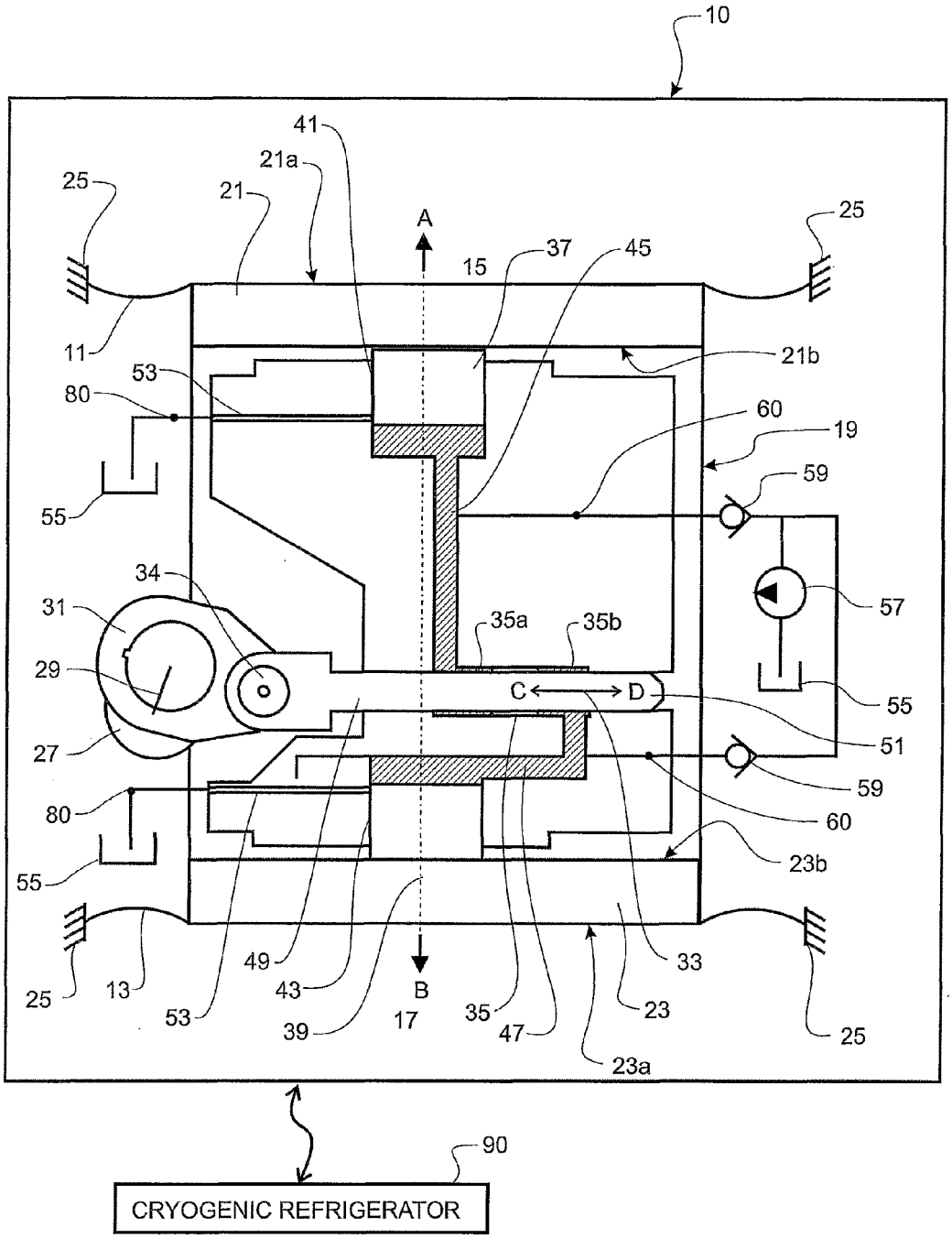
FIG. 1A shows a schematic diagram of a first preferred form of drive system of the invention.

Referring to FIG. 1A, the first preferred form drive system 10 for the diaphragm pressure wave generator is shown and will be described. For clarity, only the opposed diaphragms 11, 13 and drive piston 19 of the pressure wave generator are shown. The remaining components, such as the housing and inlet/outlet ports, and general operation of the pressure wave generator are described in WO 2006/112741. The pressure wave generator comprises a drive piston 19 that has a second 13 diaphragms are annular and their inner edges are fixed to respective outer peripheral edges of the top 21 and bottom 23 end plates of the drive piston 19. The outer edges of the diaphragms are fixed or anchored at points 25 within the housing (not shown) of the pressure wave generator.

In operation, the drive system reciprocates the drive piston 19 back and forth along a longitudinal drive piston axis that extends through the center of the opposed annular diaphragms 11,13, and which is indicated by arrows A and B. As the drive piston 19 reciprocates axially, the diaphragms 11,13 reciprocate back and forth to generate pressure waves in their respective gas spaces 15,17 of the housing of the pressure wave generator. The top 21 and bottom 23 end plates of the drive piston 19 each comprise external 21*a*,23*a* and internal 21*b*,23*b* surfaces. The external surfaces 21*a*,23*a* of the end plates 21,23 face into the respective gas spaces 15,17 within which the pressure waves are generated. The internal surfaces 21*b*,23*b* of the end plates 21,23 face in toward the sealed environment provided within the housing of the pressure wave generator between the diaphragms 11,13.

The drive system for reciprocating the drive piston 19 is located between the opposed diaphragms 11, 13. At a general level, the drive system comprises an operable actuator that generates a reciprocating motion output with a low force and long stroke, and a hydraulic amplifier that is operatively coupled between the actuator and drive piston 19 for converting the reciprocating motion output from the actuator into an amplified output having a higher force and shorter stroke for reciprocating the drive piston. In operation, the drive system must deliver considerable force over a relatively small distance to the drive piston 19 to generate the pressure waves required to drive, for example, the cryogenic refrigerator system(s) 90 that are connected to the pressure wave generator. With the hydraulic amplifier, the high force and short strokes required to reciprocate the drive piston can be generated with an efficient and low cost linear actuator that generates a low force and long stroke reciprocating output.

In the first preferred form, the operable actuator comprises a rotatable crank shaft 27 having a crank 29 to which a conrod 31 is coupled. In operation, a motor drives the rotatable crank shaft 27 to thereby reciprocate the conrod 31 with a low force and long stroke output. It will be appreciated that other operable actuators that generate low force and long stroke outputs could alternatively be utilised. For example, a Scotch Yoke, Atkinson mechanism, linear motor and other mechanisms that produce a reciprocating movement could alternatively be used if desired.

In the first preferred form, the hydraulic amplifier comprises a master piston 33 that is reciprocally moveable within a master cylinder 35 having first 35*a* and second 35*b* chambers formed on either side of the master piston. The master piston 33 is arranged to reciprocate axially back and forth along a master piston axis that extends centrally through the master piston, and which is represented by arrows C and D. In the first preferred form, the master cylinder 35 is in the form of a balanced double-acting hydraulic cylinder. The hydraulic amplifier also comprises opposed top 37 and bottom 39 slave pistons that are reciprocally moveable within respective top 41 and bottom 43 slave cylinders. The first 35*a* and second 35*b* chambers of the master cylinder 35 are hydraulically connected by hydraulic lines 45,47 carrying hydraulic fluid to respective slave cylinders 41,43. It will be appreciated that hydraulic lines 45,47 may be any suitable form of conduit or tubing, whether rigid or flexible.

The slave pistons 37,39 each abut or are coupled to the internal surface 21*b*,23*b* of a respective top 21 or bottom 23 end plate of the drive piston 19. In operation, reciprocating movement of the master piston 33 within the master cylinder 35 causes hydraulic fluid to be pumped into and out of the slave cylinders 41,43 in an alternating fashion thereby causing the slave pistons 37,39 to reciprocally extend from and then retract back into their respective slave cylinders in an alternating cycle. Extension or retraction of the slave pistons 37,39 causes a corresponding displacement of the drive piston 19 and thereby a reciprocating motion of the diaphragms 11,13 to generate pressure waves. The slave pistons 37,39, preferably but not necessarily, reciprocate axially back and forth along a common slave piston axis that extends centrally through the opposed pistons. Preferably, the slave pistons are arranged centrally within the drive piston such that their slave piston axis is substantially aligned with the drive piston axis AB so that the drive and slave pistons are co-axial. Alternatively, the drive and slave piston axes are at least parallel. In the first preferred form, the slave piston axis is substantially perpendicular to the master piston axis CD. However, it will be appreciated that the slave piston axis could be at any angle to the master piston axis CD in alternative forms of the drive system.

In the hydraulic amplifier arrangement, the slave pistons 37,39 are arranged to extend and retract reciprocally within their respective cylinders 41,43 in a coordinated manner to work on the drive piston 19 in the same direction. In other words, when one slave piston is extending, the other slave piston is retracting. By way of example, when the master piston 33 moves into the first chamber 35*a* of the master cylinder 35, hydraulic fluid is pumped into the top slave cylinder 41 thereby causing the top slave piston 37 to extend and act upwardly against the top end plate 21 of the drive piston 19 to cause it to move with a corresponding upward displacement. The upward displacement of the drive piston 19 causes the bottom end plate 23 to act upwardly against the bottom slave piston 39 to cause it to retract into its slave cylinder 43 thereby pumping hydraulic fluid into the second chamber 35*b* of the master cylinder 35. The opposite occurs when the master piston 33 moves into the second chamber 35*b* of the master cylinder 35, resulting in extension of bottom slave piston 39, and retraction of top slave piston 37, and a corresponding downward displacement of the drive piston 19.

In the first preferred form, the slave pistons 37,39 have a larger surface area or cross-sectional area than the master piston 33 such that reciprocating motion of the master piston at a low force and long stroke is converted into a corresponding reciprocal motion of the slave pistons at a higher force and shorter stroke to thereby reciprocate the drive piston 19 in the required manner to generate the pressure waves.

In first the preferred form, a piston rod 49 extends from one side of the master piston 33 through the first chamber 35*a* of the master cylinder 35 for pivotal connection 34 to the conrod 31 of the actuator. Optionally, a balancing rod 51 may extend from the opposite side of the master piston 33 through the second chamber 35*b* of the master cylinder 35.

Figure 1B:
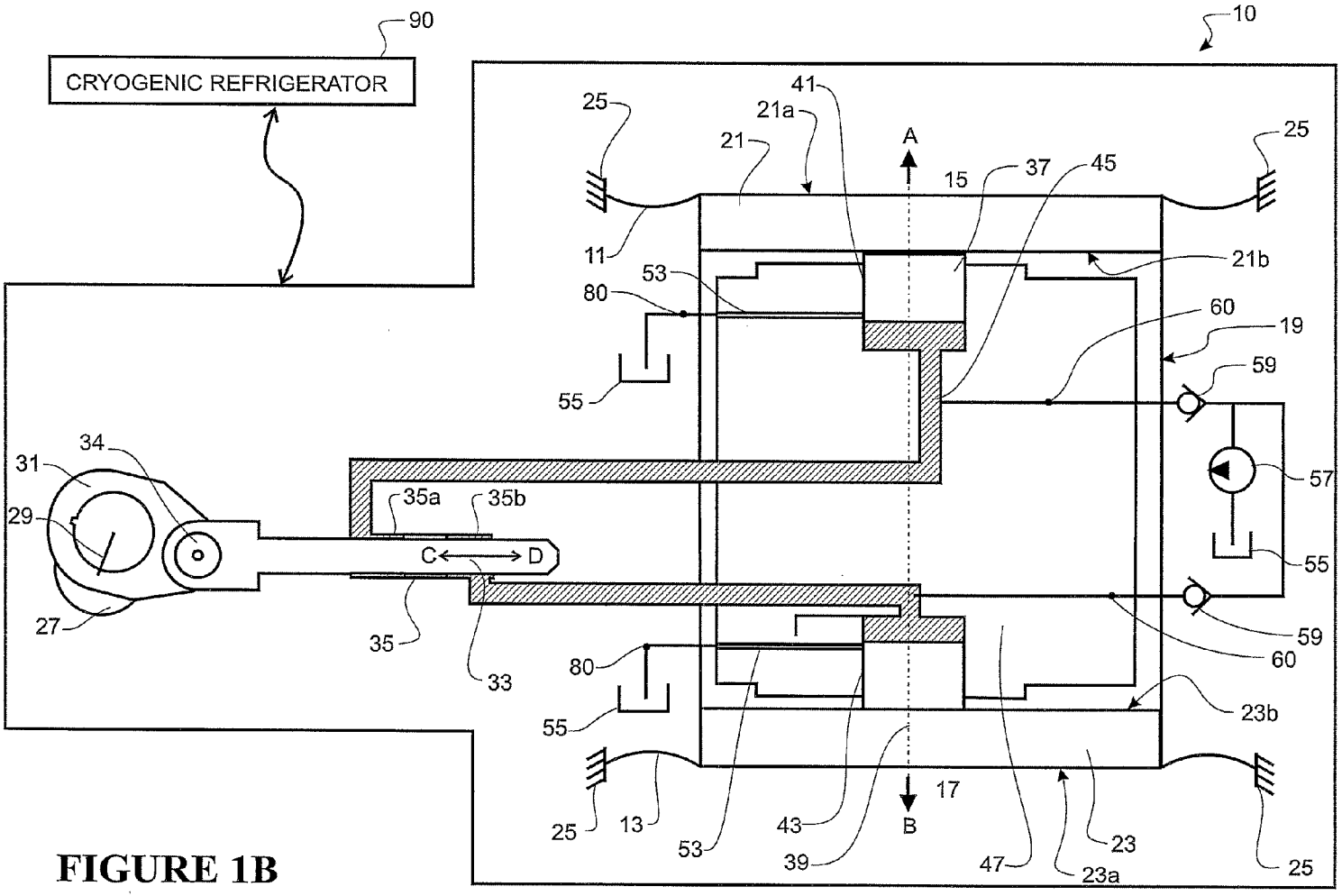
FIG. 1B shows a schematic diagram of another preferred form of drive system of the invention.

In the first preferred form, the master piston 33 and master cylinder 35 (collectively referred to as the 'master system') and the slave pistons 37, 39 and respective slave cylinders 41, 43 (collectively referred to as the 'slave system') are separated from each other but connected and in fluid communication via hydraulic lines 45, 47. While the operable actuator and master system is shown in FIG. 1 as being located substantially between the opposed diaphragms 11, 13 within the same housing of the pressure wave generator, it will be appreciated that in alternative forms the operable actuator and master system may be located in a separate housing that is displaced from the pressure wave generator. In effect, the operable actuator and master system may be displaced from the slave system and diaphragm arrangement 11, 13 by any desired distance depending on the application. For example, the hydraulic lines 45, 47 connecting the master system and slave system may be any suitable length and can be varied to suit particular applications such that in alternative forms the master system and its associated operable actuator may be externally mounted in separate housing, module or environment relative to that of the slave system and pressure wave generator housing, as shown in FIG. 1B.

The hydraulic amplifier system preferably, but not necessarily, comprises relief ducts 53 that are connected into the slave cylinders 41,43. The relief ducts 53 open and vent hydraulic fluid to a reservoir tank or tanks 55 via overflow lines 80 should the slave pistons 37,39 extend too far out of their respective slave cylinders 41,43, and which can be a predetermined distance for example. Additionally, or alternatively, the oil supply lines 60 may themselves act as relief ducts. A hydraulic pump 57 supplied by reservoir tank or tanks 55 is also provided for injecting hydraulic fluid into the hydraulic lines 45,47 should top-up hydraulic fluid be required during operation of the drive system. Preferably, check valves 59 may be provided to prevent backflow in the top up oil supply lines 60, although these are optional. In operation, the check valves 59 open on the retraction or return stroke of the respective slave piston 37,39 when the hydraulic fluid pressure is at its lowest in the respective hydraulic lines 45,47. It will be appreciated that the check valves 59 do not necessarily have to be connected to the hydraulic lines 45,47 and that they may alternatively be directly connected to the first 35*a* and second 35*b* chambers of the master cylinder 35 via input ports if desired or other suitable places in the hydraulic system. In a further alternative form, fixed porting may be provided that opens at the bottom of the slave piston strokes.

Second Preferred Form of Drive System

Figure 2:
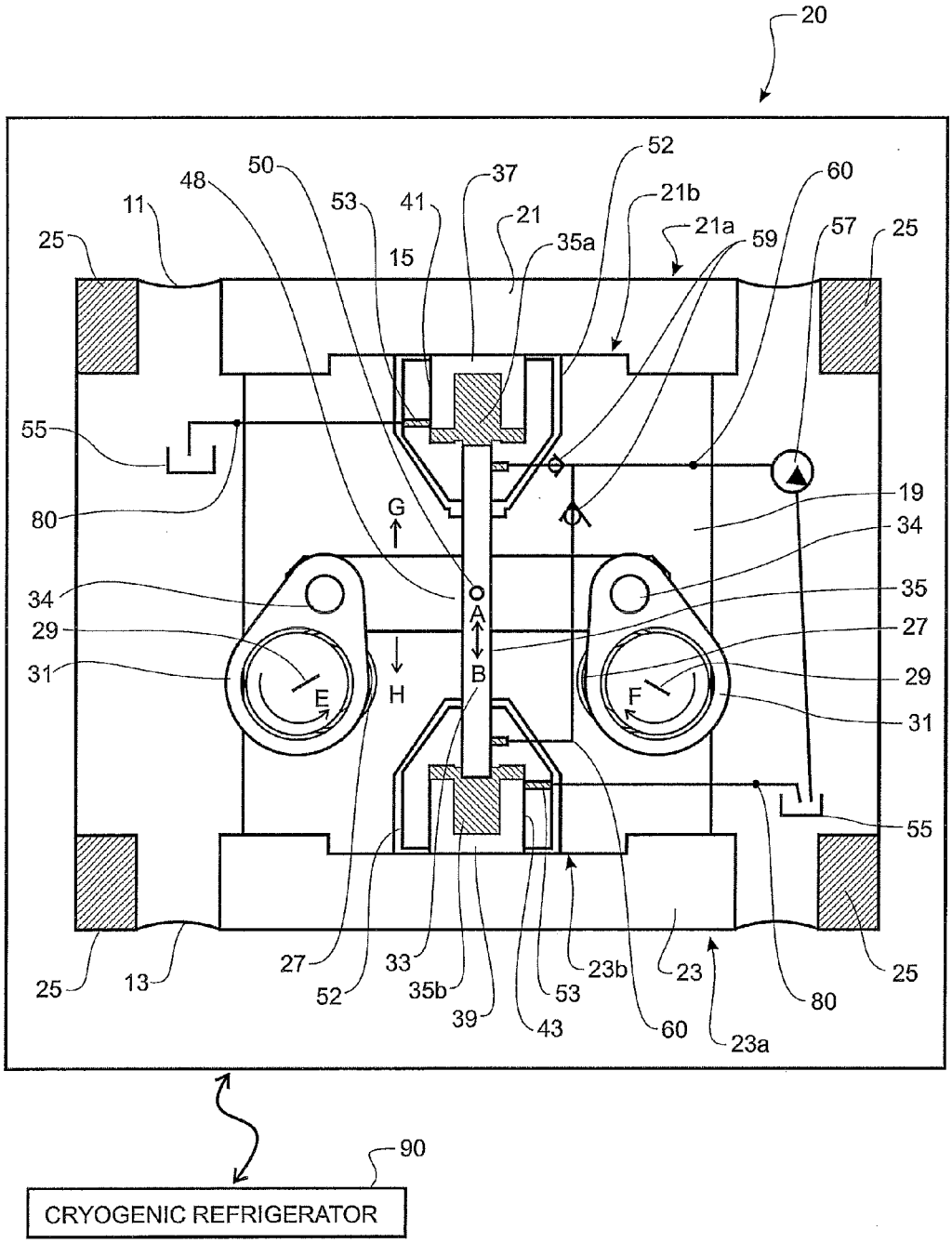
FIG. 2 shows a schematic diagram of a second preferred form of drive system of the invention.

Referring to FIG. 2, the second preferred form drive system 20 will be described. The second preferred form drive system 20 is similar in operation to the first preferred form drive system 10, and like reference numbers represent the same or similar components. The significant difference between the first 10 and second 20 forms is the arrangement of the operable actuator and hydraulic amplifier.

In the second preferred form, the master cylinder 35 and slave cylinders 41,43 are directly coupled to each other such that they share the same cavity. Hydraulic connecting lines are not used. By way of example, the master 35 and slave 41,43 cylinders are integrally formed as one component, or alternatively they may be separate components that are fixed together by welding, bolting or any other fixing means. The first 35*a* and second 35*b* chambers of the master cylinder 35 share common spaces with respective top 41 and bottom 43 slave cylinders. In particular, the first chamber 35*a* is collectively formed from the top slave cylinder 41 cavity and the adjacent upper section of the master cylinder 35 cavity. The second chamber 35*b* is collectively formed from the bottom slave cylinder 43 cavity and the adjacent lower section of the master cylinder 35 cavity. Each chamber 35*a*,35*b* contains hydraulic fluid.

In the second preferred form, the master piston 33 reciprocates axially back and forth along a master piston axis that is aligned with the slave piston axis, such that they are coaxial. Preferably, but not necessarily, the master and slave piston axes are also aligned with the drive piston axis AB. It will be appreciated that other arrangements may be formed in which the master piston axis is simply parallel to the slave piston axis.

The master piston 33 is driven back and forth along its master piston axis by an operable actuator. In the second preferred form, the operable actuator comprises a pair of counter-rotating crank shafts 27 that are located on opposite sides of the master piston 33. Each crank shaft 27 has a crank 29 to which a conrod 31 is coupled. The conrods 31 are pivotably coupled to opposite ends of a horizontal link bar 48 at points 34. The link bar 48 extends transversely across the master piston 33 such that its longitudinal axis is perpendicular to the master piston axis. Preferably, but not necessarily, the link bar 48 is coupled centrally to the master piston 33 at point 50. A motor (not shown) drives the crank shafts 27 in opposite directions via a gearing system, such as a pair of gears (not shown), such that synchronous counter rotation of the crank shafts is achieved. For example, one crank shaft 27 is rotated clockwise in direction F and the other is rotated anti-clockwise in direction E or vice versa, and this causes the conrods 31 to reciprocate the link bar 48 up and down in the direction indicated by arrows G and H. Reciprocation of the link bar 48 causes a corresponding reciprocal movement of the master piston 33 along its master piston axis, for example AB.

Operation of the hydraulic amplifier arrangement in the second preferred form 20 is similar to that of the first preferred form 10. As the master piston 33 reciprocates back and forth in directions AB, the slave pistons 37,39 extend and retract in an alternating fashion to drive the drive piston 19 and diaphragms 11,13 to generate pressure waves. For example, as the master piston moves in direction A, the hydraulic fluid in the first chamber 35*a* is pressurised and causes top slave piston 37 to extend from its slave cylinder 41 and act against the top plate 21 of the drive piston 19 to move the drive piston in direction A. As the drive piston 19 moves up in direction A, the bottom plate 23 of the drive piston acts on the bottom slave piston 39 to cause the slave piston to retract into its respective slave cylinder 43. The opposite occurs when the master piston moves downward in direction B, with the bottom slave piston 39 extending from its slave cylinder 43 causing a corresponding downward displacement of the drive piston 19 and the top slave piston 37 retracting into its slave cylinder 41. As with the first preferred form, the slave pistons 37,39 work together to reciprocate the drive piston 19 such that when one slave piston is extending, the other is retracting. It will be appreciated that the slave pistons 37,39 may be directly coupled to their respective top 21 or bottom 23 end plates of the drive piston 19, or they may alternatively simply abut the internal surfaces of the end plates and act against them to transfer force and cause movement.

In the second preferred form, the pair of counter-rotating crank shafts of the operable actuator allows balancing of the reciprocating masses in the drive system. For example, balance of the reciprocating components can be achieved by providing counter-rotating balance weights on the crank shafts 27 and so that the conrod 31 side loads balance thereby eliminating side loads on the master piston 33. It will be appreciated that it is not necessarily essential to use a pair of counter-rotating crank shafts to drive the master piston 33 in a reciprocating motion. In alternative forms, a single motor-driven crank shaft and connecting rod drive arrangement or any other suitable operable actuator with a reciprocating output may be utilised to drive the master piston in a reciprocal motion. For example, other suitable actuators include a Scotch Yoke, Atkinson mechanism, linear motor and other mechanisms that produce a reciprocating movement.

In the second preferred form, relief ducts 53 are provided in the slave cylinders 41,43 to prevent overstroke of the slave pistons 37,39 as described with reference to the first preferred form drive system 10. Preferably, the relief ducts can vent to tank(s) 55 via overflow lines 80. Additionally, or alternatively, the oil supply lines 60 connected toward each end of the master cylinder 35 may act as relief ducts. A hydraulic pump 57 supplied by reservoir tank or tanks 55 is also preferably provided for injecting hydraulic fluid into the chambers 35*a*, 35*b* via the oil supply lines 60 should top-up hydraulic fluid be required during operation of the drive system. In some forms, check values 59 may be provided in the oil supply lines 60, but these are optional. Operation of the check valves 59 is similar to that described in respect of the first preferred form drive system 10. Alternatively, or additionally, fixed porting 52 may be provided that extends between each slave cylinder 41,43 and respective upper and lower sections of the master cylinder 35. For example, any leakage of hydraulic fluid from the slave cylinders 41,43 is ported directly back into upper and lower sections of the master cylinder 35 that form the first 35*a* and second 35*b* chambers.

Like the first preferred form drive system 10, the second preferred form drive system 20 comprises slave pistons 37,39 that have a larger surface area or cross-sectional area than the master piston 33 such that reciprocating motion of the master piston at a low force and long stroke is converted to a corresponding reciprocal motion of the slave pistons at a higher force and shorter stroke to thereby reciprocate the drive piston 19 in the required manner to generate the pressure waves.

Example Specifications

An example of possible drive system specifications for the first 10 and second 20 preferred forms in a cryogenic refrigerator system application will be now be explained. These specifications are by way of example only and are not intended to be limiting. It will be appreciated that the drive systems may be adapted to suit various design specifications for various applications.

In a cryogenic refrigerator system application where the pressure wave generator is used to generate pressure waves, the frequency of the drive piston 19 and diaphragms 11,13 is preferably in the order of 30-60 Hz. The slave pistons 37,39 preferably have a stroke length in the range of 1-4 mm. The stroke length of the master piston 33 is preferably in the range of 5-15 times the slave piston stroke length, and more preferably about 10 times the slave piston stroke length. The master:slave piston stroke length ratio is linked to the master: slave piston cross-sectional area ratio, which is preferably in the range of 1:5-1:15, and more preferably about 1:10. Peak hydraulic fluid pressure in the hydraulic amplifier is preferably in range of 50-200 Bar, and more preferably about 100 Bar, with pressure swing in the pressure wave generator in the order of +/−5 Bar.

Applications and Other Alternative Forms of Drive System

The drive system may be utilised in any suitable pressure wave generator application. By way of example, the drive system may be utilised in a pressure wave generator that is operating in a cryogenic refrigerator system, such as a Stirling refrigerator or pulse tube. Alternatively, the drive system could be utilised in a diaphragm helium pump for cryogenic refrigerator systems or any other diaphragm pumps for other fluids and gases.

It will be appreciated that other hydraulic amplifiers based on the master and slave arrangement may alternatively be implemented in the drive system. For example, the master piston could be arranged to drive more than one pair of opposed slave pistons or multiple master pistons driving one or more slave pistons could be provided in alternative arrangements.

Advantages and Benefits

The hydraulic amplifier of the drive system allows a long stroke, low force actuator, such as a motor crank system, to move the short stroke, high force drive piston of the pressure wave generator. In particular, the hydraulic amplifier of the drive system employs a master piston of relatively small cross-sectional area and relatively long movement to drive a pair of slave pistons which are of relatively large cross-sectional area and thereby move a relatively small distance.

Either of the first or second preferred forms of the drive system can be employed depending on design requirements. Each preferred form may lend itself more suitably to particular applications. By way of example, the first preferred form system can be employed in drive systems in which it is desirable to separate the actuator and master system from the slave system and diaphragms via the use of hydraulic connecting lines. Having the operable actuator, for example motor and crank, and master piston and cylinder physically separated from the diaphragms may be an advantage if a particular application does not suit having the motor nearby. The separation of the operable actuator and master system from the slave system and diaphragms also allows for modular construction, which can be easier to maintain. By way of example, the second preferred form drive system may be employed where it is desirable to have a direct connection between the master and slave systems such that they share the same cylinder cavities. Having integrated master and slave systems allows a more compact design that could be suitable for particular applications. The integral design is also inherently able to be balanced to a high degree.

The foregoing description of the invention includes preferred forms thereof. Modifications may be made thereto without departing from the scope of the invention as described by the accompanying claims.

The invention claimed is:

1. A cryogenic refrigerator system comprising:

a diaphragm pressure wave generator, the pressure wave generator comprising opposed first and second diaphragms that are each coupled at or toward opposite ends of a reciprocally moveable drive piston, the diaphragm pressure wave generator being driven by a drive system comprising:

an operable actuator that generates a reciprocating motion output;

a master piston that is driven by the output of the actuator in a reciprocating motion within a double-acting balanced master cylinder having two ends; and opposed slave pistons being reciprocally moveable within respective slave cylinders, each slave piston being arranged to act on a respective one of the opposite ends of the drive piston and each slave cylinder being operatively connected to a respective one of the two ends of the master cylinder for hydraulic fluid communication such that the master piston drives the slave pistons via hydraulic fluid moving between the master and slave cylinders in isolation from the two opposed first and second diaphragms such that the hydraulic fluid does not contact the diaphragms, the slave pistons having a larger cross-sectional area than the master piston such that reciprocating motion of the master piston at a low force and long stroke causes reciprocating motion of the slave pistons at a higher force and shorter stroke to thereby reciprocate the drive piston and opposed diaphragms to generate pressure waves; and one or more cryogenic refrigerators operatively connected to the diaphragm pressure wave generator such that they are driven by the generated pressure waves; and wherein the master cylinder and slave cylinders are directly coupled to each other such that they share the same cylinder cavities.

2. A cryogenic refrigerator system according to claim 1 wherein each end of the master cylinder extends directly into a respective slave cylinder, and wherein the master and slave cylinders are integrally formed as one component.

3. A cryogenic refrigerator system according to claim 1 wherein the drive piston reciprocates back and forth along a drive piston axis that extends through its longitudinal center.

4. A cryogenic refrigerator system according to claim 3 wherein the slave pistons are arranged to reciprocate back and fourth along a slave piston axis that is substantially coaxial with the drive piston axis of the drive piston.

5. A cryogenic refrigerator system according to claim 4 wherein the master piston is arranged to reciprocate back and fourth along a master piston axis that is substantially parallel or aligned with the slave piston axis.

6. A cryogenic refrigerator system according to claim 1 wherein the drive piston comprises a body having opposed circular top and bottom end plates, the first and second diaphragms being annular with inner and outer edges, the inner edges of the first and second diaphragms being fixed to the respective outer peripheral edges of the top and bottom end plates of the drive piston, and the outer edges of the diaphragms being fixed within a housing of the pressure wave generator.

7. A cryogenic refrigerator system according to claim 6 wherein the top and bottom end plates of the drive piston comprise external surfaces that face respective gas spaces within which the diaphragms move to create pressure waves and internal surfaces that face inwardly toward the body of the drive piston and the sealed environment between the opposed diaphragms.

8. A cryogenic refrigerator system according to claim 6 wherein each of the slave pistons is arranged to abut the internal surface of a respective end plate of the drive piston such that extension of the slave piston from its slave cylinder causes a corresponding displacement of the drive piston in the same direction.

9. A cryogenic refrigerator system according to claim 6 wherein each of the slave pistons is fixed to the internal surface of a respective end plate of the drive piston such that extension of the slave piston from its slave cylinder causes a corresponding displacement of the drive piston in the same direction.

10. A cryogenic refrigerator system according to claim 1 wherein each slave cylinder comprises a relief duct that is arranged to vent hydraulic fluid to a tank if the slave pistons extend beyond a predetermined distance from their respective slave cylinders during operation.

11. A cryogenic refrigerator system according to claim 1 further comprising a hydraulic pump that is arranged to pump hydraulic fluid from a tank into the master and/or slave cylinders to top up the hydraulic fluid supply when required.

12. A cryogenic refrigerator system according to claim 11 wherein the hydraulic pump is arranged to pump hydraulic fluid into the master and/or slave cylinders via hydraulic oil supply lines each having a check valve.

13. A cryogenic refrigerator system according to claim 1 having a master:slave piston cross-sectional area ratio in the range of about 1:5 to about 1:15.

14. A cryogenic refrigerator system according to claim 13 wherein the master:slave piston cross-sectional area ratio is in the range of about 1:10.

15. A cryogenic refrigerator system comprising:

a diaphragm pressure wave generator, the pressure wave generator comprising opposed first and second diaphragms that are each coupled at or toward opposite ends of a reciprocally moveable drive piston, the diaphragm pressure wave generator being driven by a drive system comprising:

an operable actuator that generates a reciprocating motion output;

a master piston that is driven by the output of the actuator in a reciprocating motion within a double-acting balanced master cylinder having two ends; and opposed slave pistons being reciprocally moveable within respective slave cylinders, each slave piston being arranged to act on a respective one of the opposite ends of the drive piston and each slave cylinder being operatively connected to a respective one of the two ends of the master cylinder for hydraulic fluid communication such that the master piston drives the slave pistons via hydraulic fluid moving between the master and slave cylinders in isolation from the two opposed first and second diaphragms such that the hydraulic fluid does not contact the diaphragms, the slave pistons having a larger cross-sectional area than the master piston such that reciprocating motion of the master piston at a low force and long stroke causes reciprocating motion of the slave pistons at a higher force and shorter stroke to thereby reciprocate the drive piston and opposed diaphragms to generate pressure waves; and one or more cryogenic refrigerators operatively connected to the diaphragm pressure wave generator such that they are driven by the generated pressure waves; and wherein the actuator comprises a pair of counter-rotating crank shafts located on opposite sides of the master piston, the crank shafts connected to each other by a pair of gears in such a manner as to achieve synchronous counter rotation, each crank shaft having a crank to which a conrod is coupled, the conrods being operatively coupled to respective ends of a link bar that is coupled to the master piston, wherein rotation of the crank shafts by a motor causes reciprocation of the link bar to thereby reciprocate the master piston within its master cylinder.

16. A cryogenic refrigerator system according to claim 15 wherein the master cylinder and slave cylinders are directly coupled to each other such that they share the same cylinder cavities.

17. A cryogenic refrigerator system according to claim 16 wherein each end of the master cylinder extends directly into a respective slave cylinder, and wherein the master and slave cylinders are integrally formed as one component.

18. A cryogenic refrigerator system according to claim 15 wherein the drive piston reciprocates back and forth along a drive piston axis that extends through its longitudinal center.

19. A cryogenic refrigerator system according to claim 18 wherein the slave pistons are arranged to reciprocate back and fourth along a slave piston axis that is substantially coaxial with the drive piston axis of the drive piston.

20. A cryogenic refrigerator system according to claim 19 wherein the master piston is arranged to reciprocate back and fourth along a master piston axis that is substantially parallel or aligned with the slave piston axis.

21. A cryogenic refrigerator system according to claim 15 wherein the drive piston comprises a body having opposed circular top and bottom end plates, the first and second diaphragms being annular with inner and outer edges, the inner edges of the first and second diaphragms being fixed to the respective outer peripheral edges of the top and bottom end plates of the drive piston, and the outer edges of the diaphragms being fixed within a housing of the pressure wave generator.

22. A cryogenic refrigerator system according to claim 21 wherein the top and bottom end plates of the drive piston comprise external surfaces that face respective gas spaces within which the diaphragms move to create pressure waves and internal surfaces that face inwardly toward the body of the drive piston and the sealed environment between the opposed diaphragms.

23. A cryogenic refrigerator system according to claim 22 wherein the entire drive system is located substantially between the opposed diaphragms in the housing of the pressure wave generator.

24. A cryogenic refrigerator system according to claim 21 wherein each of the slave pistons is arranged to abut the internal surface of a respective end plate of the drive piston such that extension of the slave piston from its slave cylinder causes a corresponding displacement of the drive piston in the same direction.

25. A cryogenic refrigerator system according to claim 21 wherein each of the slave pistons is fixed to the internal surface of a respective end plate of the drive piston such that extension of the slave piston from its slave cylinder causes a corresponding displacement of the drive piston in the same direction.

26. A cryogenic refrigerator system according to claim 15 wherein each slave cylinder comprises a relief duct that is arranged to vent hydraulic fluid to a tank if the slave pistons extend beyond a predetermined distance from their respective slave cylinders during operation.

27. A cryogenic refrigerator system according to claim 15 further comprising a hydraulic pump that is arranged to pump hydraulic fluid from a tank into the master and/or slave cylinders to top up the hydraulic fluid supply when required.

28. A cryogenic refrigerator system according to claim 27 wherein the hydraulic pump is arranged to pump hydraulic fluid into the master and/or slave cylinders via hydraulic oil supply lines each having a check valve.

29. A cryogenic refrigerator system according to claim 15 having a master:slave piston cross-sectional area ratio in the range of about 1:5 to about 1:15.

30. A cryogenic refrigerator system according to claim 29 wherein the master:slave piston cross-sectional area ratio is in the range of about 1:10.

31. A cryogenic refrigerator system comprising:

a diaphragm pressure wave generator, the pressure wave generator comprising opposed first and second diaphragms that are each coupled at or toward opposite ends of a reciprocally moveable drive piston, the diaphragm pressure wave generator being driven by a drive system comprising:

an operable actuator that generates a reciprocating motion output;

a master piston that is driven by the output of the actuator in a reciprocating motion within a double-acting balanced master cylinder having two ends; and opposed slave pistons being reciprocally moveable within respective slave cylinders, each slave piston being arranged to act on a respective one of the opposite ends of the drive piston and each slave cylinder being operatively connected to a respective one of the two ends of the master cylinder for hydraulic fluid communication such that the master piston drives the slave pistons via hydraulic fluid moving between the master and slave cylinders in isolation from the two opposed first and second diaphragms such that the hydraulic fluid does not contact the diaphragms, the slave pistons having a larger cross-sectional area than the master piston such that reciprocating motion of the master piston at a low force and long stroke causes reciprocating motion of the slave pistons at a higher force and shorter stroke to thereby reciprocate the drive piston and opposed diaphragms to generate pressure waves; and one or more cryogenic refrigerators operatively connected to the diaphragm pressure wave generator such that they are driven by the generated pressure waves; and wherein the drive piston comprises a body having opposed circular top and bottom end plates, the first and second diaphragms being annular with inner and outer edges, the inner edges of the first and second diaphragms being fixed to the respective outer peripheral edges of the top and bottom end plates of the drive piston, and the outer edges of the diaphragms being fixed within a housing of the pressure wave generator; and wherein the top and bottom end plates of the drive piston comprise external surfaces that face respective gas spaces within which the diaphragms move to create pressure waves and internal surfaces that face inwardly toward the body of the drive piston and the sealed environment between the opposed diaphragms; and wherein the entire drive system is located substantially between the opposed diaphragms in the housing of the pressure wave generator.

32. A cryogenic refrigerator system according to claim 31 wherein the master cylinder and slave cylinders are indirectly operatively connected by hydraulic lines that carry hydraulic fluid between the cylinders in response to movement of the master piston.

33. A cryogenic refrigerator system according to claim 32 wherein the master cylinder comprises first and second chambers on either side of the master piston, each chamber being formed at or toward an end of the master cylinder, and wherein the hydraulic lines carry hydraulic fluid between the first chamber and one of the respective slave cylinders, and the second chamber and another of the respective slave cylinders.

34. A cryogenic refrigerator system according to claim 31 wherein the master cylinder and slave cylinders are directly coupled to each other such that they share the same cylinder cavities.

35. A cryogenic refrigerator system according to claim 34 wherein each end of the master cylinder extends directly into a respective slave cylinder, and wherein the master and slave cylinders are integrally formed as one component.

36. A cryogenic refrigerator system according to claim 33 further comprising a piston rod that extends from one side of the master piston through the first chamber of the master cylinder and a balancing rod that extends from the opposite side of the master piston through the second chamber of the master cylinder.

37. A cryogenic refrigerator system according to claim 36 wherein the piston rod is coupled to the output of the actuator in order to reciprocate the master piston within its master cylinder.

38. A cryogenic refrigerator system according to claim 37 wherein the actuator comprises a rotatable crank shaft having a crank to which a conrod is coupled such that rotation of the crank shaft by a motor causes reciprocating motion of conrod, the conrod being operatively coupled to the piston rod of the master piston to drive it back and fourth in a reciprocating motion within its master cylinder.

39. A cryogenic refrigerator system according to claim 31 wherein the drive piston reciprocates back and forth along a drive piston axis that extends through its longitudinal center.

40. A cryogenic refrigerator system according to claim 39 wherein the slave pistons are arranged to reciprocate back and fourth along a slave piston axis that is substantially coaxial with the drive piston axis of the drive piston.

41. A cryogenic refrigerator system according to claim 39 wherein the master piston is arranged to reciprocate back and fourth along a master piston axis that extends substantially perpendicular to the slave piston axis.

42. A cryogenic refrigerator system according to claim 40 wherein the master piston is arranged to reciprocate back and fourth along a master piston axis that is substantially parallel or aligned with the slave piston axis.

43. A cryogenic refrigerator system according to claim 31 wherein each of the slave pistons is arranged to abut the internal surface of a respective end plate of the drive piston such that extension of the slave piston from its slave cylinder causes a corresponding displacement of the drive piston in the same direction.

44. A cryogenic refrigerator system according to claim 31 wherein each of the slave pistons is fixed to the internal surface of a respective end plate of the drive piston such that extension of the slave piston from its slave cylinder causes a corresponding displacement of the drive piston in the same direction.

45. A cryogenic refrigerator system according to claim 31 wherein each slave cylinder comprises a relief duct that is arranged to vent hydraulic fluid to a tank if the slave pistons extend beyond a predetermined distance from their respective slave cylinders during operation.

46. A cryogenic refrigerator system according to claim 31 further comprising a hydraulic pump that is arranged to pump hydraulic fluid from a tank into the master and/or slave cylinders to top up the hydraulic fluid supply when required.

47. A cryogenic refrigerator system according to claim 46 wherein the hydraulic pump is arranged to pump hydraulic fluid into the master and/or slave cylinders via hydraulic oil supply lines each having a check valve.

48. A cryogenic refrigerator system according to claim 31 having a master:slave piston cross-sectional area ratio in the range of about 1:5 to about 1:15.

49. A cryogenic refrigerator system according to claim 48 wherein the master:slave piston cross-sectional area ratio is in the range of about 1:10.

* * * * *